US008143791B2

(12) United States Patent
Maeda

(10) Patent No.: US 8,143,791 B2
(45) Date of Patent: Mar. 27, 2012

(54) CONTROL SYSTEM FOR LIGHT-EMITTING DEVICE

(75) Inventor: Patrick Yasuo Maeda, Mountain View, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 592 days.

(21) Appl. No.: 12/334,269

(22) Filed: Dec. 12, 2008

(65) Prior Publication Data

US 2010/0148693 A1 Jun. 17, 2010

(51) Int. Cl.
*H05B 37/02* (2006.01)

(52) U.S. Cl. ..... 315/152; 315/308; 315/323; 362/612; 362/613; 362/617; 362/623; 362/231; 362/97.3

(58) Field of Classification Search ..... 315/149, 315/152, 291, 307, 308, 312, 323, 324; 362/612, 362/613, 615, 617, 623, 97.1, 97.2, 97.3, 362/230, 231; 345/102
See application file for complete search history.

(56) References Cited

U.S. PATENT DOCUMENTS

| | | | | |
|---|---|---|---|---|
| 7,324,080 | B1 * | 1/2008 | Hu et al. | 345/102 |
| 7,651,235 | B2 * | 1/2010 | Seki | 362/97.3 |
| 7,959,341 | B2 * | 6/2011 | Erchak et al. | 362/612 |
| 2008/0106512 | A1 * | 5/2008 | Schwab | 345/102 |

* cited by examiner

*Primary Examiner* — Thuy Vinh Tran
(74) *Attorney, Agent, or Firm* — Marger Johnson & McCollom, P.C.

(57) ABSTRACT

A control system for a light-emitting device may include test circuitry, photodetectors, and process circuitry. The test circuitry is configured to sequentially drive individual groups of light-emitting elements in a light-emitting device during a test sequence. Each group of light-emitting elements includes one or more light-emitting elements. The photodetectors are configured to detect an intensity of light present at a plurality of locations of the light-emitting device during the test sequence and generate a detection signal corresponding to the detected intensity of light. The process circuitry is configured to process the detection signals and transmit an adjustment signal based on the processing. The light-emitting elements may then be driven such that at least one characteristic of light emitted by all of the plurality of light-emitting elements is substantially the same at each of the plurality of locations of the light-mixing region.

18 Claims, 10 Drawing Sheets

CONTROL SYSTEM FOR LIGHT-EMITTING DEVICE

TECHNICAL FIELD

Embodiments exemplarily described herein relate generally to control systems for light-emitting devices and, more particularly, to control systems capable of providing color and brightness uniformity correction of light-emitting devices incorporating multiple light-emitting elements.

BACKGROUND

Light-emitting elements such as light emitting diodes (LEDs) are increasingly being incorporated within light-emitting devices such as backlights, general lighting systems, and other types of luminaires. Characteristics (e.g., color, color temperature, correlated color temperature, whitepoint, brightness, or the like) of light emitted by LEDs fabricated by different manufacturers can vary. Moreover, characteristics (e.g., color, color temperature, correlated color temperature, whitepoint, brightness, or the like) of light emitted by the same type of LEDs fabricated by the same manufacturer can vary due to variations in batch-to-batch processes. To ensure that light emitted by all of the plurality of LEDs of a light-emitting device has desired characteristics (e.g., color, color temperature, correlated color temperature, whitepoint, brightness, or the like), the light emitted by each individual LED must be separately analyzed during a binning process, which can be costly and time intensive.

Over time, the characteristics of light emitted by an LED often changes. Moreover, characteristics of light emitted by LEDs fabricated by different manufacturers can change at different rates over time due to variations in fabrication processes between different manufacturers. In addition, characteristics of light emitted by LEDs fabricated by the same manufacturer can change at different rates over time due to variations in batch fabrication processes. Therefore, characteristics of light emitted by all of the plurality of LEDs of a light-emitting device can change over time at different rates in different locations of the light-emitting device.

It was the understanding and recognition of these and other problems associated with the conventional art that formed the impetus for the embodiments exemplarily described herein.

DETAILED DESCRIPTION OF THE EMBODIMENTS

Figure 1:
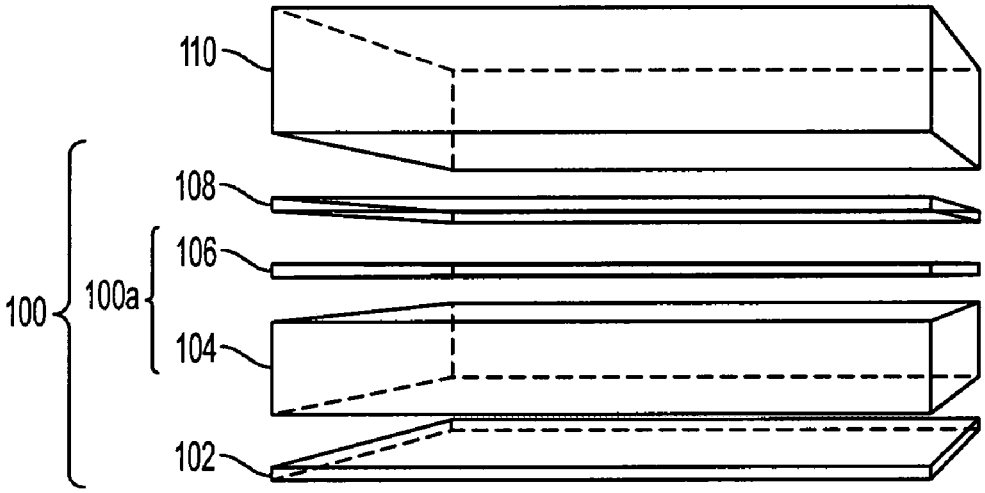
FIG. 1 is a perspective view schematically illustrating a light-emitting device within which a control system may be incorporated.

FIG. 1 is a perspective view schematically illustrating a light-emitting device within which a control system may be incorporated.

Referring to FIG. 1, a light-emitting device 100 may, for example, include a reflector 102, a light guide 104, a diffuser 106 and a prism sheet 108. The light-emitting device 100 may also include a plurality of light-emitting elements (not shown). The light-emitting device 100 may be used in a display device such as a liquid crystal display (LCD) device. Accordingly, the light-emitting device 100 may be disposed at the rear surface of an LCD panel 110.

As will be discussed in greater detail below, the plurality of light-emitting elements are configured to emit light upon receiving electric current. Accordingly, the light-emitting device 100 may further include driving circuitry (not shown) coupled to the plurality of light-emitting elements, which is configured to drive the plurality of light-emitting elements by supplying electric current thereto. As used herein, the term "circuitry" refers to any type of computer-executable instructions that can be implemented as, for example, hardware, firmware, and/or software. The driving circuitry may be provided as a dedicated fixed-purpose circuitry and/or partially or wholly programmable circuitry.

Light emitted by the plurality of light-emitting elements is transmitted into the light guide 104. The light guide 104 may be configured to internally reflect and/or diffuse light emitted by the plurality of light-emitting elements.

The reflector 102 is disposed on a rear surface of the light guide 104 and has a reflective surface configured to reflect light that would otherwise be transmitted through the rear surface of the light guide 104, back into the light guide 104. Thus, the reflective surface of the reflector 102 may be configured to reflect light emitted by the plurality of light-emitted elements. Although not shown, the reflector 102 may also be disposed on side surfaces of the light guide 104 to reflect light that would otherwise be transmitted through the side surfaces of the light guide 104, back into the light guide 104.

The diffuser 106 is disposed on a front surface of the light guide 104 and diffuses light transmitted through the front surface of the light guide 104, thereby increasing the uniformity of light emitted by the light-emitting device 100. Because light emitted by the light-emitting elements can be diffused or mixed within the light guide 104 and/or the diffuser 106, the combined structure of the light guide 104 and the diffuser 106 can be referred to as a light-mixing region 100*a* of the light-emitting device 100. The light-mixing region 100*a* can be generally characterized as being configured to receive light emitted by the plurality of light-emitting elements. It will be appreciated that the diffuser 106 may be omitted from the light emitting device 100 if desired.

The prism sheet 108 optimizes the angle of light transmitted by the diffuser 106 and ultimately emitted by the light-emitting device 100. It will be appreciated that the prism sheet may be omitted from the light-emitting device 100 if desired.

Although not illustrated, the light-emitting device 100 may include additional features and components such as light outcoupling structures, light-scattering structures, brightness-enhancing films, patterned films, or the like, as is known in the art.

According to some embodiments, the plurality of light-emitting devices are provided as a plurality of light-emitting diodes (LED). Over time, the color and brightness of light emitted by an LED changes. Accordingly, one or more characteristics (e.g., color, color temperature, correlated color temperature, whitepoint, intensity, emittance, brightness, or the like) of light emitted by the light-emitting device 100 may change over time. Moreover, LEDs fabricated by different manufacturers, or even the same manufacturer, can change at different rates over time. Accordingly, one or more of the aforementioned characteristics of light emitted by the light-emitting device 100 may change at different rates in different locations of the light-emitting device 100. Thus, the uniformity of one or more characteristics of light emitted by the light-emitting device 100 may deteriorate over time. In view of the above, the light-emitting device 100 may further include a control system configured to prevent or reduce the rate of deterioration of characteristics of light emitted by the light-emitting device 100.

Figure 2:
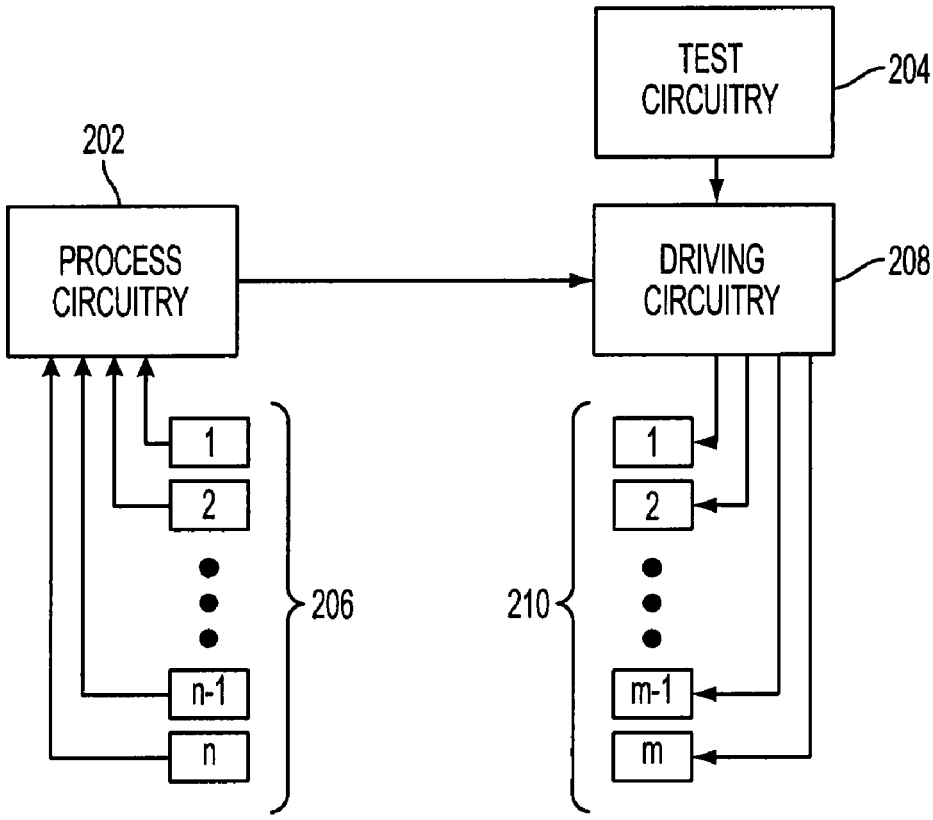
FIG. 2 is a schematic view illustrating a control system according to some embodiments.
Figure 3:
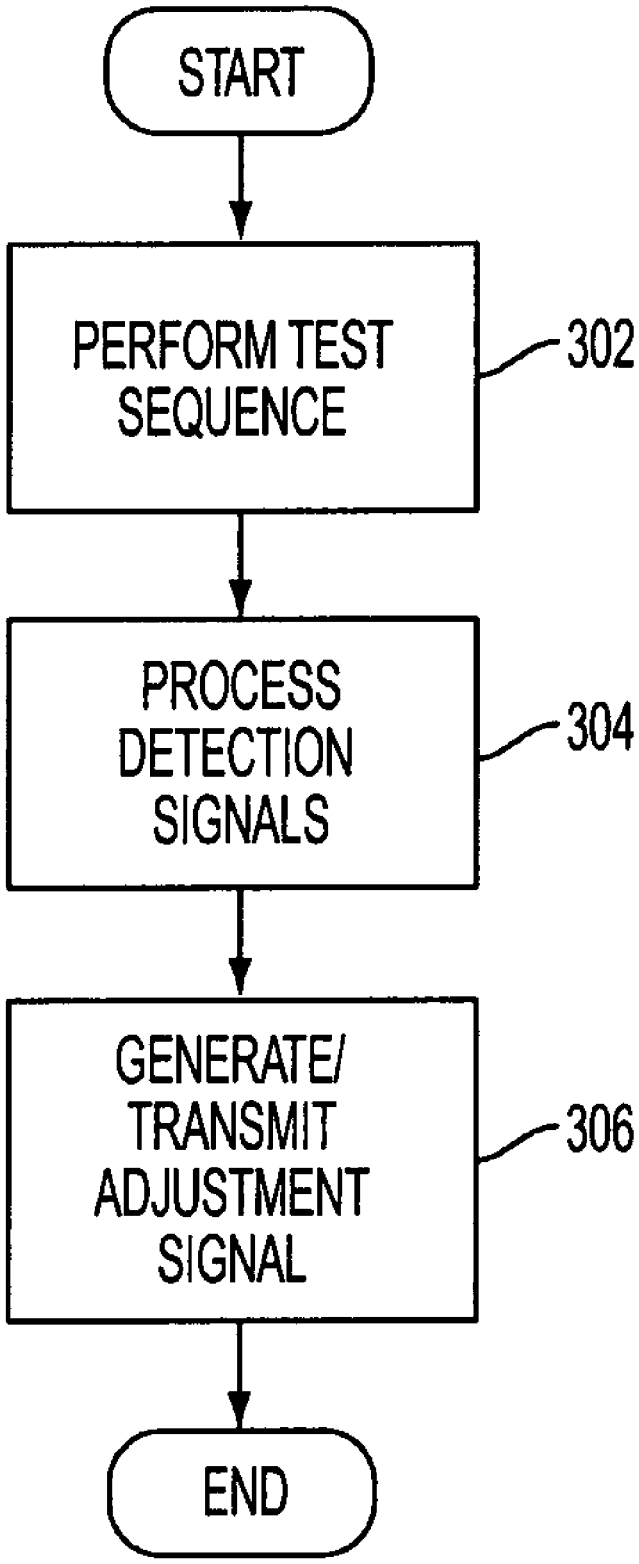
FIG. 3 illustrates a flow chart describing an exemplary method of controlling a light-emitting device, according to some embodiments.

FIG. 2 is a schematic view illustrating a control system according to some embodiments. FIG. 3 illustrates a flow chart describing an exemplary method of controlling a light-emitting device, according to some embodiments.

Referring to FIG. 2, a control system according to some embodiments may, for example, include process circuitry 202, test circuitry 204 and a plurality of photodetectors 206. As exemplarily illustrated, the plurality of photodetectors 206 may include n number of photodetectors 206.

The process circuitry 202 and the test circuitry 204 may be coupled the aforementioned driving circuitry 208 which, in turn, is coupled to a plurality of light-emitting devices 210. As exemplarily illustrated, the plurality of light-emitting elements 210 may include m number of light-emitting elements.

In one embodiment, the plurality of light-emitting elements 210 may be divided into a plurality of groups of light-emitting elements 210, wherein each group of light-emitting elements 210 includes one or more light-emitting elements 210. Generally, a light-emitting element 210 within a group of light-emitting elements 210 can be driven independently of light-emitting elements 210 within other groups of light-emitting elements 210. Thus, within a group of light-emitting elements 210, a plurality of light-emitting elements 210 are driven together. To be driven together, the plurality of light-emitting elements 210 within a group of light-emitting elements 210 may be electrically connected together or the driving circuitry 208 may be configured to the plurality of light-emitting elements 210 simultaneously.

The intensity with which each light-emitting element 210 emits light may be controlled by controlling the amount of current applied to the light-emitting element 210, by controlling the amount of time that a predetermined amount of current is applied to the light emitting element 210 within a time period, or a combination thereof. Accordingly, the driving circuitry 208 may be configured to supply electric current that has been amplitude-modulated, pulse width-modulated, or a combination thereof.

The intensity of light emitted by each of the plurality of light-emitting elements 210 may affect at least one characteristic of light (e.g., color, color temperature, correlated color temperature, whitepoint, intensity, emittance, brightness, or the like) present at a location of the light-mixing region 100*a* during operation of the light-emitting device. Thus, the intensity of light emitted by each of the plurality of light-emitting elements 210 may affect at least one of the aforementioned characteristics of light emitted by the light-emitting device 100. In one embodiment, the plurality of photodetectors 206 may be arranged at a plurality of locations of the light-mixing region 100*a*. Accordingly, the plurality of photodetectors 206 may be configured to detect an intensity of light received at a corresponding plurality of locations of the light-mixing region 100*a*. Each of the plurality of photodetectors 206 may also be configured to generate a detection signal corresponding to the intensity of the detected light. In one embodiment, the plurality of photodetectors 206 may be sensitive to different colors of light. Accordingly, the plurality of photodetectors 206 may be variously provided as one or more photodetectors sensitive to red light, one or more photodetectors sensitive to green light and one or more photodetectors sensitive to blue light.

The test circuitry 204 may be configured to perform a test sequence. During the test sequence, the driving circuitry 208 is controlled to supply electric current to a plurality of groups of light-emitting elements 210 in sequence, wherein each of the plurality of groups of light-emitting elements 210 includes one or more light-emitting elements 210. When the plurality of groups of light-emitting elements 210 are sequentially driven, only one of the plurality of groups of light-emitting elements 210 emits light at any time. In one embodiment, the plurality of groups of light-emitting elements 210 can be sequentially driven by the test circuitry 204 periodically, during dimming of the light-emitting elements 210, upon start-up of the light-emitting device, or the like or a combination thereof.

During the test sequence (i.e., when the plurality of groups of light-emitting elements 210 are sequentially driven by the test circuitry 204), the plurality of photodetectors 206 detect an intensity of light emitted by individual groups of the plurality of groups of light-emitting elements 210 at a plurality of locations of the light-mixing region 100*a*. See 302 in FIG. 3. The detection signals generated by each of the plurality of photodetectors 206 may be transmitted to the process circuitry 202.

The process circuitry 202 may be configured to process detection signals generated by the plurality of photodetectors 206. See 304 in FIG. 3. In one embodiment, the process circuitry 202 is configured to process detection signals to determine the amount of electric current that should be supplied to each group of light-emitting elements 210 so that at least one of the aforementioned characteristics of light emitted by all of the plurality of light-emitting elements 210 is substantially the same at each of the plurality of locations of the light-mixing region 100*a*.

In some embodiments, the intensity or flux of light, D, detected by a particular photodetector 206 corresponds to the electric current, I, supplied to a particular group of light-emitting elements 210 multiplied by a coupling coefficient, C, associated with the particular photodetector 206 and the particular group of light-emitting elements 210. This relationship can be described for n photodetectors 206 and m groups of light-emitting elements 210 as follows:

$$\begin{bmatrix} D_1 \\ D_2 \\ D_3 \\ \vdots \\ D_{n-1} \\ D_n \end{bmatrix} = \begin{bmatrix} C_{1,1} & C_{1,2} & C_{1,3} & \cdots & C_{1,m-1} & C_{1,m} \\ C_{2,1} & C_{2,2} & C_{2,3} & \cdots & C_{2,m-1} & C_{2,m} \\ C_{3,1} & C_{3,2} & C_{3,3} & \cdots & C_{3,m-1} & C_{3,m} \\ \vdots & \vdots & \vdots & \ddots & \vdots & \vdots \\ C_{n-1,1} & C_{n-1,2} & C_{n-1,3} & \cdots & C_{n-1,m-1} & C_{n-1,m} \\ C_{n,1} & C_{n,2} & C_{n,3} & \cdots & C_{n,m-1} & C_{n,m} \end{bmatrix} \begin{bmatrix} I_1 \\ I_2 \\ I_3 \\ \vdots \\ I_{m-1} \\ I_m \end{bmatrix}, \quad \text{(Eq. 1)}$$

where:

$$I_{Least\ Squares} = (C^T C)^{-1} C^T D. \quad \text{(Eq. 2)}$$

Values for the C matrix may be obtained upon performing the test sequence. After obtaining values for the C matrix, values for the elements of the D matrix are selected based on a desired color, color temperature, correlated color temperature, whitepoint, intensity, emittance, brightness, or the like or a combination thereof. In one embodiment, values for the elements of the D matrix are selected by choosing the desired brightness level and desired color of the output light from the light-emitting device 100 which will determine red (R), green (G), and blue (B) intensity or flux values to assign to the D elements corresponding to the one or more photodetectors sensitive to red light, the one or more photodetectors sensitive to green light and the one or more photodetectors sensitive to blue light. Next, equation 2 is solved to determine, on a least squares basis, the amount of electric current that needs to be supplied to each of the plurality of groups of light-emitting elements 210 such that at least one characteristic of light emitted by all of the plurality of groups of light-emitting elements 210 is substantially the same at each of the plurality of locations of the light-mixing region 100*a*.

Subsequently, the process circuitry 202 generates an adjustment signal to the based on the processing of the detection signals and transmits the adjustment signal to the driving circuitry 208. See 306 in FIG. 3. In one embodiment, electric current supplied to the plurality of light-emitting elements 210 by the driving circuitry 208 is adjustable based on the adjustment signal such that at least one characteristic of light emitted by all of the plurality of light-emitting elements 210 is substantially the same at each of the plurality of locations of the light-mixing region 100*a*. Thus, in response to the adjustment signal, the driving circuitry 208 is configured to supply electric current to the plurality of light-emitting elements 210 such that at least one characteristic of light emitted by all of the plurality of light-emitting elements 210 is substantially the same at each of the plurality of locations of the light-mixing region 100*a*.

In one embodiment, the plurality of photodetectors 206 may be further configured to detect ambient light received at the plurality of locations of the light-mixing region 100*a* before the test sequence is performed (e.g., when no electric current is supplied to the plurality of light-emitting elements 210). Accordingly, each of the plurality of photodetectors 206 may be configured generate a detection signal corresponding to the intensity of ambient light. The process circuitry 202 may further be configured to adjust values of the coupling coefficients in matrix C based on the detection signals generated in response to the ambient light detected, prior to selecting the elements of the D matrix.

It will be appreciated that other conditions/constraints can be added to the matrices of equation 1 as necessary. In one embodiment, the plurality of photodetectors 210 may be calibrated prior to being used in the control system exemplarily described with respect to FIG. 2.

Figure 4:
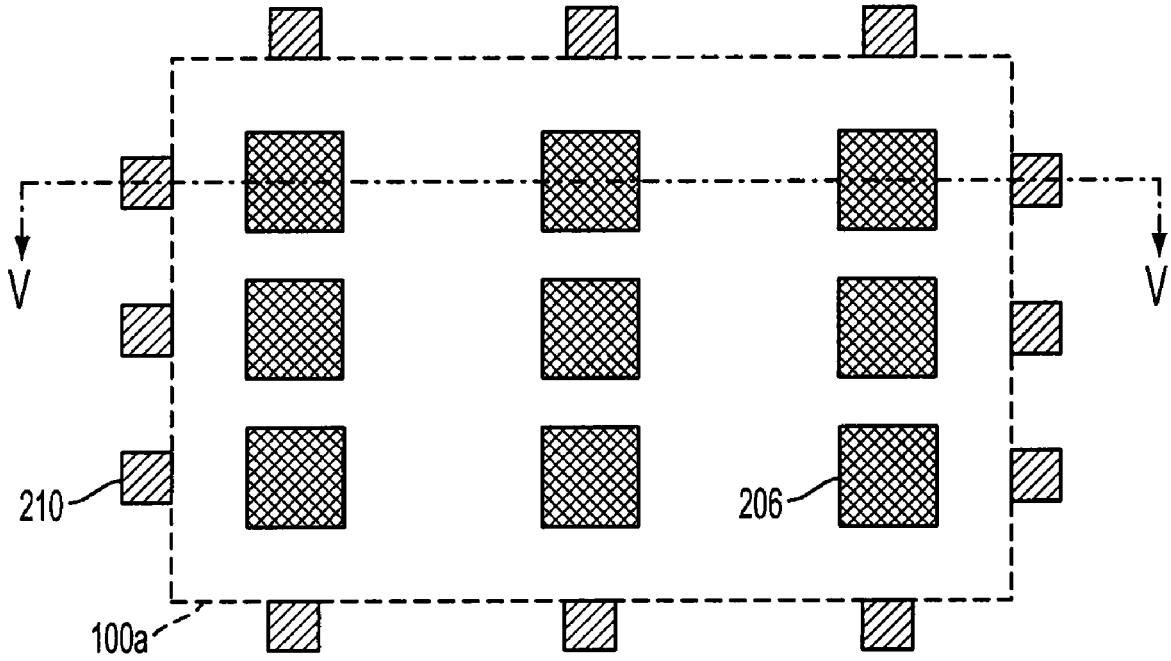
FIG. 4 is a plan view schematically illustrating an arrangement of light-emitting elements and photodetectors within the light-emitting device shown in FIG. 1, according to one embodiment.

FIG. 4 is a plan view schematically illustrating an arrangement of light-emitting elements and photodetectors within the light-emitting device shown in FIG. 1, according to one embodiment. FIGS. 5-10 are cross-sectional views taken along line V-V of FIG. 4, illustrating exemplary arrangements of light-emitting elements and photodetectors within the light-emitting device shown in FIG. 1, according to some embodiments.

Referring to FIG. 4, the periphery of the light-mixing region 100*a* is delineated by a dashed line. The plurality of light-emitting elements 210 are arranged outside the periphery of the light-mixing region 100*a* and the plurality of photodetectors 206 are arranged at a plurality of locations within the periphery of the light-mixing region 100*a*.

Figure 5:
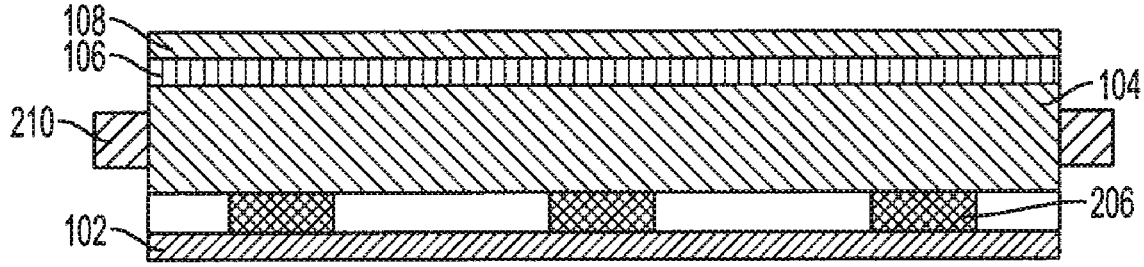
FIGS. 5-10 are cross-sectional views taken along line V-V of FIG. 4, illustrating exemplary arrangements of light-emitting elements and photodetectors within the light-emitting device shown in FIG. 1, according to some embodiments.

Referring to FIG. 5, the plurality of light-emitting elements 210 may be configured to transmit light through side surfaces of the light guide 104 and the plurality of photodetectors 206 may be configured to receive light transmitted through the rear surface of the light guide 104. Accordingly, the plurality of light-emitting elements 210 may be arranged at side surfaces of the light guide 104 and the plurality of photodetectors 206 may be arranged at the rear surface of the light guide 104, below the front surface of the light guide 104, above the reflective surface of the reflector 102.

Figure 6:
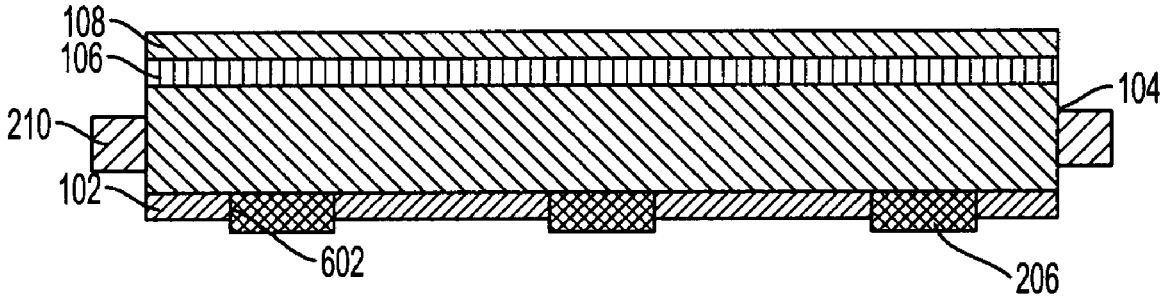

Referring to FIG. 6, similar to the embodiment shown in FIG. 5, the plurality of light-emitting elements 210 may be arranged at side surfaces of the light guide 104 and the plurality of photodetectors 206 may be arranged at the rear surface of the light guide 104. In the illustrated embodiment, however, the reflector 102 may include a plurality of openings 602 defined therein and the plurality of photodetectors 206 may be disposed within the openings 602. In the illustrated embodiment, the plurality of photodetectors 206 may be disposed within the openings 602 so as to be arranged at the reflective surface of the reflector 102. In another embodiment, however, the plurality of photodetectors 206 may be disposed within the openings 602 so as to be arranged above or below the reflective surface of the reflector 102.

Figure 7:
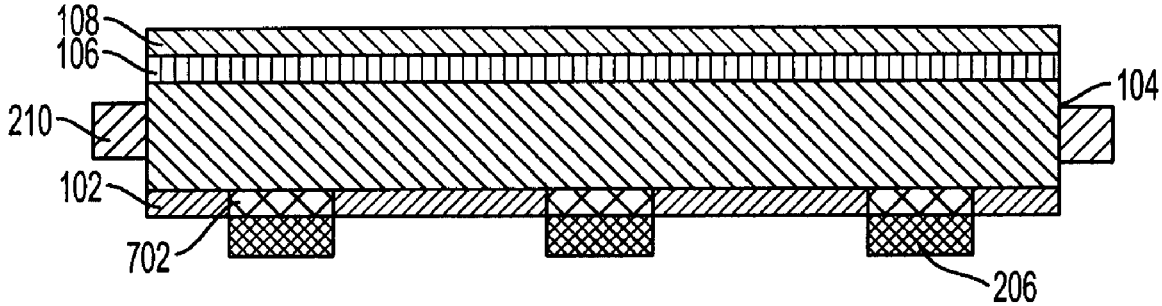

Referring to FIG. 7, similar to the embodiment shown in FIG. 5, the plurality of light-emitting elements 210 may be arranged at side surfaces of the light guide 104 and the plurality of photodetectors 206 may be arranged at the rear surface of the light guide 104. In the illustrated embodiment, however, the reflector 102 may include a plurality of partially-transmissive regions 702 defined therein. The plurality of partially-transmissive regions 702 may partially transmit light emitted by the light-emitting elements 210. The partially-transmissive regions may be formed of at least one material selected from the group consisting of a partially silvered coating, a multilayered dielectric coating on a transmissive film or substrate, or the like or a combination thereof. In the illustrated embodiment, the plurality of photodetectors 206 may be disposed adjacent to corresponding ones of the partially-transmissive regions 702.

Figure 8:
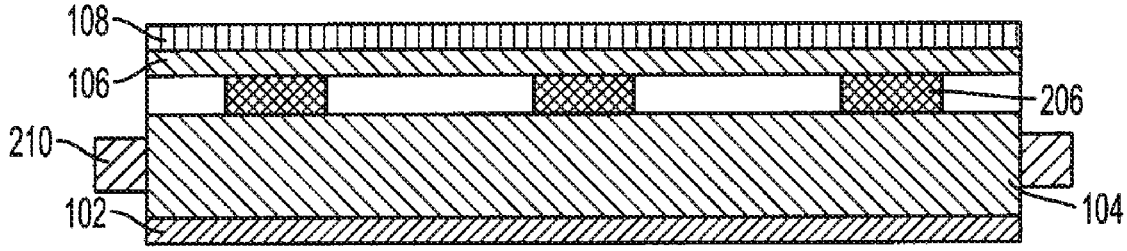

Referring to FIG. 8, similar to the embodiment shown in FIG. 5, the plurality of light-emitting elements 210 may be arranged at side surfaces of the light guide 104. In the illustrated embodiment, however, the plurality of photodetectors 206 may be configured to receive light transmitted through the front surface of the light guide 104. Accordingly, the plurality of photodetectors 206 are arranged at the front surface of the light guide 104, above the rear surface of the light guide 104, between the light guide 104 and the diffuser 106. Although not shown, the diffuser 106 may include a plurality of openings defined therein, similar to the openings 602 described with respect to FIG. 6, and the plurality of photodetectors 206 may be disposed within the openings.

Figure 9:
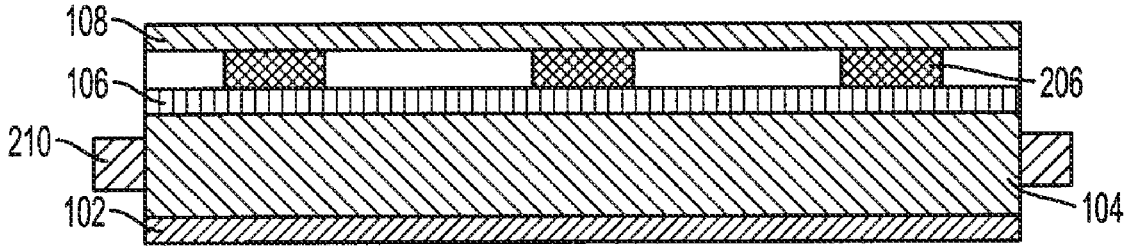

Referring to FIG. 9, similar to the embodiment shown in FIG. 8, the plurality of light-emitting elements 210 may be arranged at side surfaces of the light guide 104 and the plurality of photodetectors 206 may be arranged at the front surface of the light guide 104. In the illustrated embodiment, however, the plurality of photodetectors 206 may be disposed between the diffuser 106 and the prism sheet 108. Although not shown, the prism sheet 108 may include a plurality of openings defined therein, similar to the openings 602 described with respect to FIG. 6, and the plurality of photodetectors 206 may be disposed within the openings.

Figure 10:
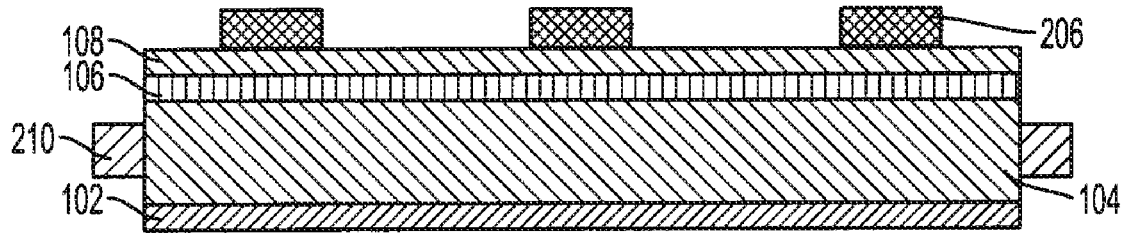

Referring to FIG. 10, similar to the embodiment shown in FIG. 8, the plurality of light-emitting elements 210 may be arranged at side surfaces of the light guide 104 and the plurality of photodetectors 206 may be arranged at the front surface of the light guide 104. In the illustrated embodiment, however, the plurality of photodetectors 206 may be disposed on the prism sheet 108.

Figure 11:
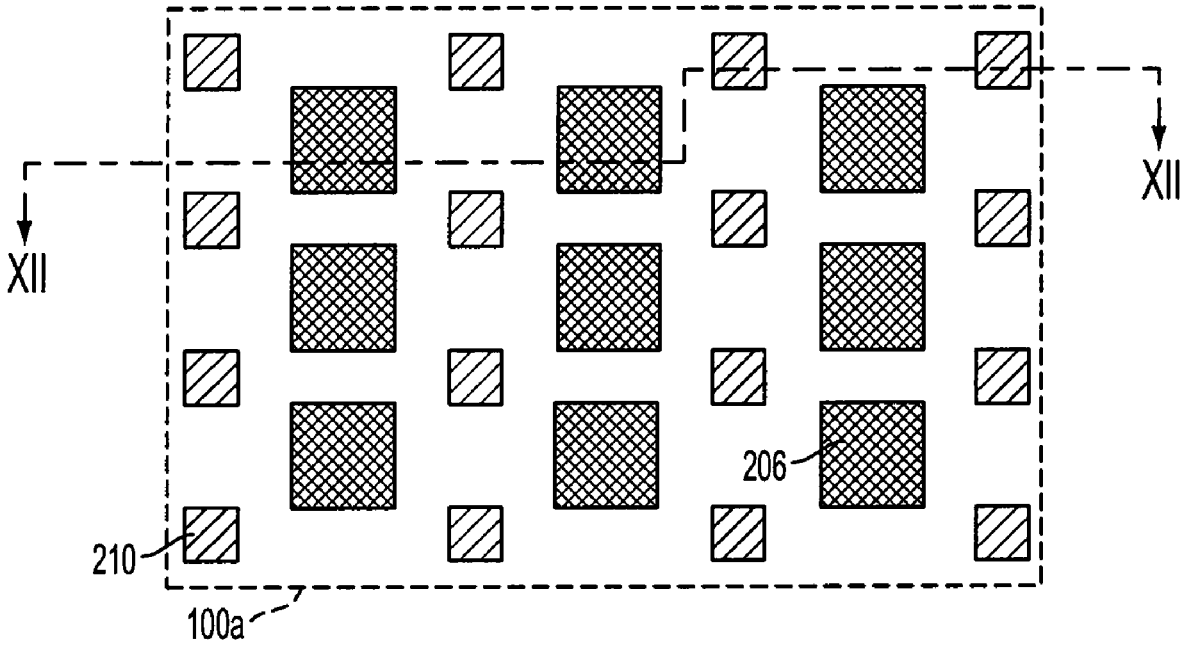
FIG. 11 is a plan view schematically illustrating an arrangement of light-emitting elements and photodetectors within the light-emitting device shown in FIG. 1, according to another embodiment.

FIG. 11 is a plan view schematically illustrating an arrangement of light-emitting elements and photodetectors within the light-emitting device shown in FIG. 1, according to another embodiment.

Referring to FIG. 11, the plurality of light-emitting elements 210 and the plurality of photodetectors 206 are arranged at a plurality of locations within the periphery of the light-mixing region 100*a*. In the illustrated embodiment, the plurality of light-emitting elements 210 may be arranged in an array and the plurality of photodetectors 206 may be disposed between light-emitting elements 210 in the array.

In one embodiment, the plurality of photodetectors 206 may be configured to receive light transmitted through the rear or front surfaces of the light guide 104 as described above with respect to FIGS. 5-10. In one embodiment, the plurality of light-emitting elements 210 may be configured to transmit light through the rear surface of the light guide 104. Accordingly, the plurality of light-emitting elements 210 may be arranged at the rear surface of the light guide 104 in the same manner that the plurality of photodetectors 206 are arranged at the rear surface of the light guide 104 as exemplarily described above with respect to FIG. 5. In another embodiment, the plurality of light-emitting elements 210 may be disposed within openings formed in the reflector 102, in the same manner that the plurality of photodetectors 206 are disposed within openings 602 as exemplarily described with respect to FIG. 6. In another embodiment, the plurality of light-emitting elements 210 may be disposed adjacent to partially-transmissive regions formed in the reflector 102, in the same manner that the plurality of photodetectors 206 are disposed adjacent to partially-transmissive regions 702 as exemplarily described with respect to FIG. 7.

Figure 12:
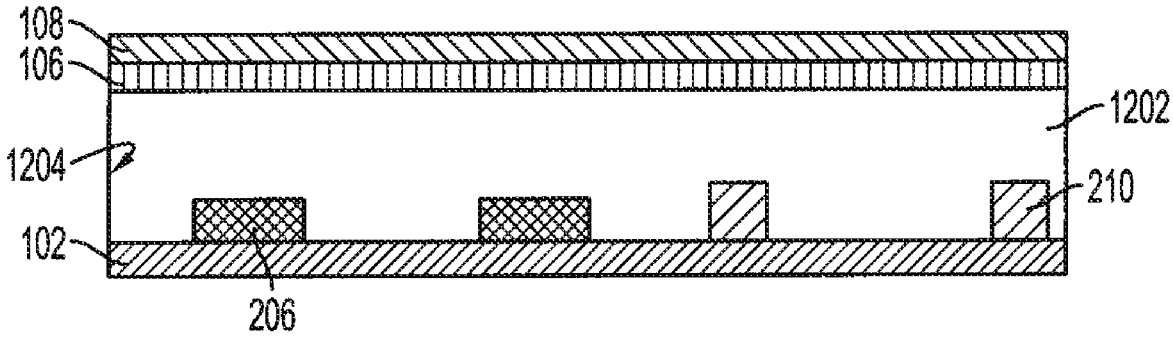
FIGS. 12 and 13 are cross-sectional views taken along line XI-XI of FIG. 11, illustrating exemplary arrangements of light-emitting elements and photodetectors within the light-emitting device shown in FIG. 1, according to some embodiments.
Figure 13:
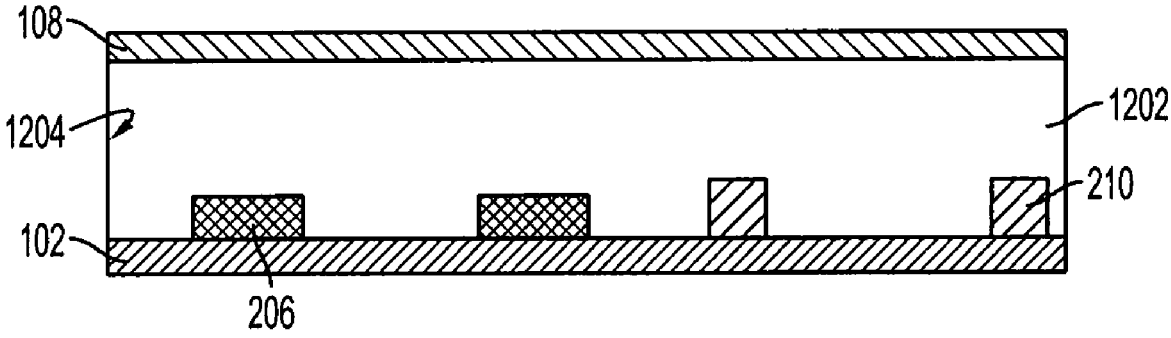

FIGS. 12 and 13 are cross-sectional views taken along line XII-XII of FIG. 11, illustrating exemplary arrangements of light-emitting elements and photodetectors within the light-emitting device shown in FIG. 1, according to some embodiments.

Figure 14:
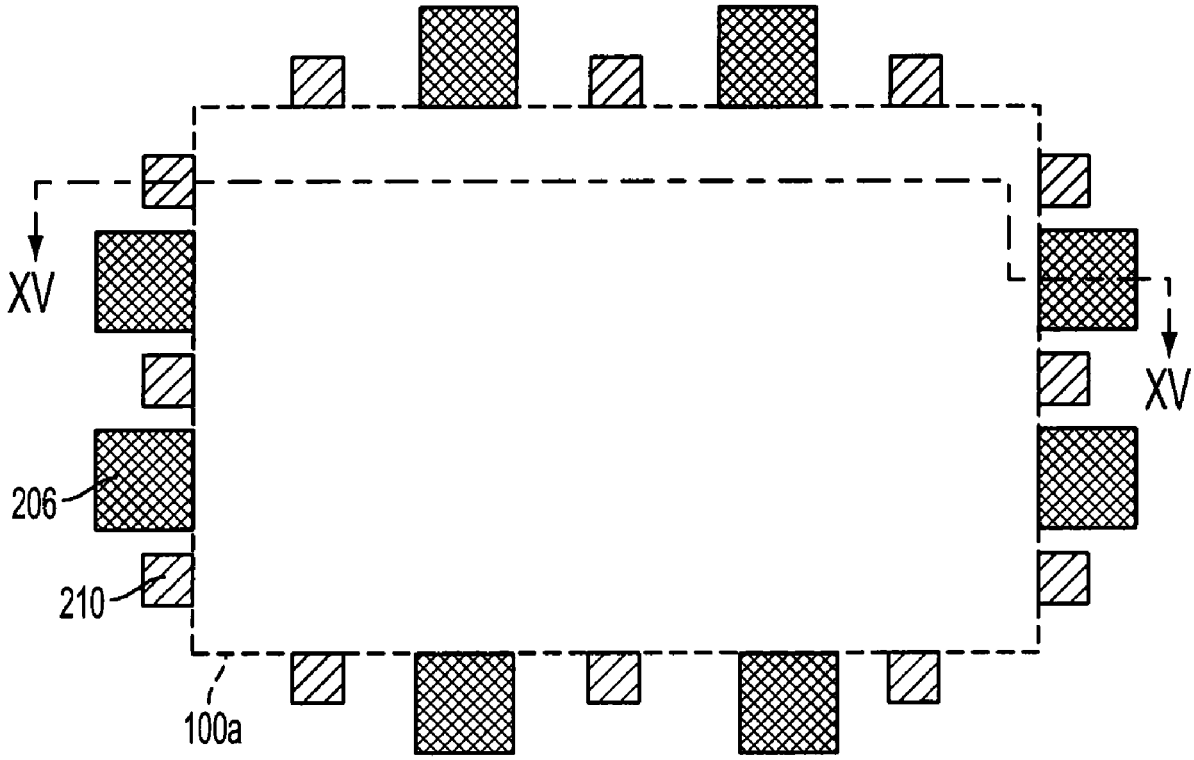
FIG. 14 is a plan view schematically illustrating an arrangement of light-emitting elements and photodetectors within the light-emitting device shown in FIG. 1, according to yet another embodiment.

As described above, the light-mixing region 100*a* may include a light guide 104 and a diffuser 106. In other embodiments, however, the light-mixing region 100*a* may include a light-mixing cavity instead of a light guide 104. Referring generally to FIGS. 12-14, a light-mixing cavity 1202 may comprise a space defined between the reflector 102 and the diffuser 106. Although not illustrated, a support may be provided to couple the reflector 102 to the diffuser 106 and define side surfaces 1204 of the light-mixing cavity 1202. In one embodiment, the side surfaces 1204 of the light-mixing cavity 1202 may comprise a reflective material to enhance the brightness of light emitted by the light-emitting device 100.

Referring to FIG. 12, the plurality of light-emitting elements 210 may be disposed at a rear surface of the light-mixing cavity 1202 and the plurality of photodetectors 206 may be configured to receive light transmitted to the rear surface of the light-mixing cavity 1202. Accordingly, the plurality of light-emitting elements 210 may be arranged at the rear surface of the light-mixing cavity 1202 and the plurality of photodetectors 206 may be arranged at the rear surface of the light-mixing cavity 1202, above the reflective surface of the reflector 102. In one embodiment, the plurality of light-emitting elements 210 may be disposed within openings formed in the reflector 102, in the same manner that the plurality of photodetectors 206 are disposed within openings 602 as exemplarily described with respect to FIG. 6. In another embodiment, the plurality of light-emitting elements 210 may be disposed adjacent to partially-transmissive regions formed in the reflector 102, in the same manner that the plurality of photodetectors 206 are disposed adjacent to partially-transmissive regions 702 as exemplarily described with respect to FIG. 7.

As described above, the plurality of photodetectors 206 are disposed at a rear surface of the light-mixing cavity 1202. In other embodiments, however, the plurality of photodetectors 206 may be disposed between the diffuser 106 and the prism sheet 108, or on the prism sheet 108, in the same manner as discussed above with respect to FIGS. 9 and 10.

Referring to FIG. 13, the light-emitting device 100 may be provided in a similar manner as described above with respect to FIG. 12. As shown in FIG. 13, however, the diffuser 106 may be omitted. Upon omitting the diffuser 106, the height of the light-mixing cavity 1202 (i.e., the distance from the reflector 102 to the prism sheet 108 may be increased to ensure that light emitted by the plurality of light-emitting elements 210 is sufficiently mixed.

Figure 15:
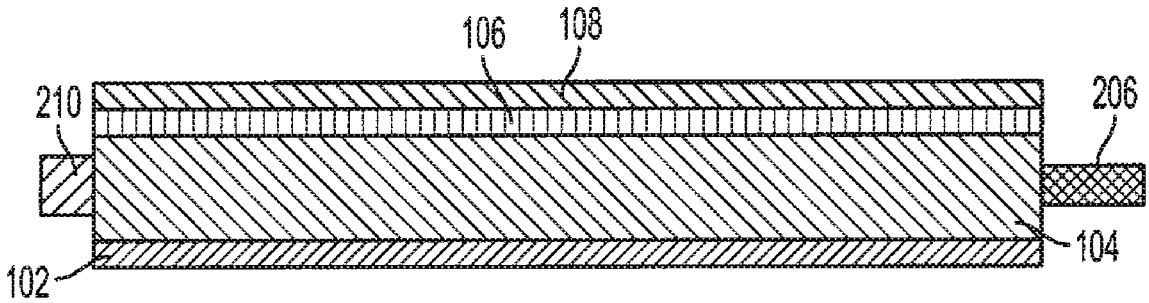
FIGS. 15 and 16 are cross-sectional views taken along line XV-XV of FIG. 14, illustrating an exemplary arrangement of light-emitting elements and photodetectors within the light-emitting device shown in FIG. 1, according to some embodiments.
Figure 16:
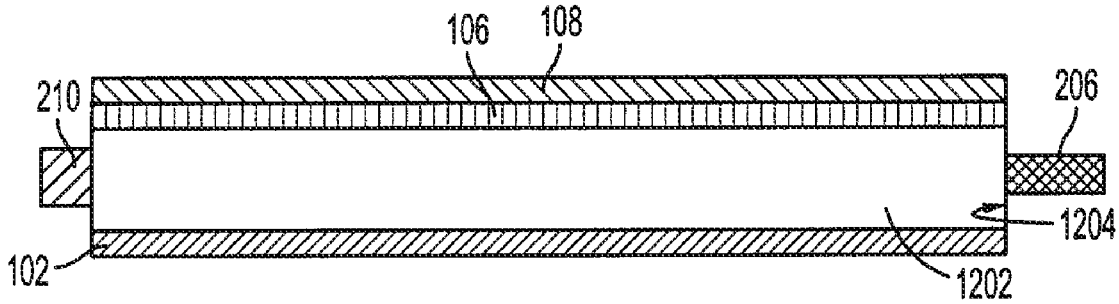

FIG. 14 is a plan view schematically illustrating an arrangement of light-emitting elements and photodetectors within the light-emitting device shown in FIG. 1, according to yet another embodiment. FIGS. 15 and 16 are cross-sectional views taken along line XV-XV of FIG. 14, illustrating an exemplary arrangement of light-emitting elements and photodetectors within the light-emitting device shown in FIG. 1, according to some embodiments.

Referring to FIG. 14, the plurality of light-emitting elements 210 are arranged outside the periphery of the light-mixing region 100*a*. Similarly, the plurality of photodetectors 206 are arranged at a plurality of locations outside the periphery of the light-mixing region 100*a*.

Referring to FIG. 15, the plurality of light-emitting elements 210 may be configured to transmit light through side surfaces of the light guide 104 and the plurality of photodetectors 206 may be configured to receive light transmitted through the side surfaces of the light guide 104. Accordingly, the plurality of light-emitting elements 210 and the plurality of photodetectors 206 may be arranged at side surfaces of the light guide 104.

Referring to FIG. 16, the light-emitting device 100 may be provided in a similar manner as exemplarily described above with respect to FIG. 15. In one embodiment, however, the light-mixing region 100*a* may include a light-mixing cavity 1202 as exemplarily discussed above with respect to FIG. 12, instead of a light guide 104. In one embodiment, each of the plurality of light-emitting elements 210 and the plurality of photodetectors 206 may be exposed to the light-mixing cavity 1202 via a corresponding opening or partially-transmissive region formed in a side surface 1204, in a manner similar to that described above with respect to FIGS. 6 and 7. In one embodiment, each of the plurality of light-emitting elements 210 and the plurality of photodetectors 206 may extend into the light-mixing cavity 1202 through a corresponding opening formed in a side surface 1204.

Figure 17:
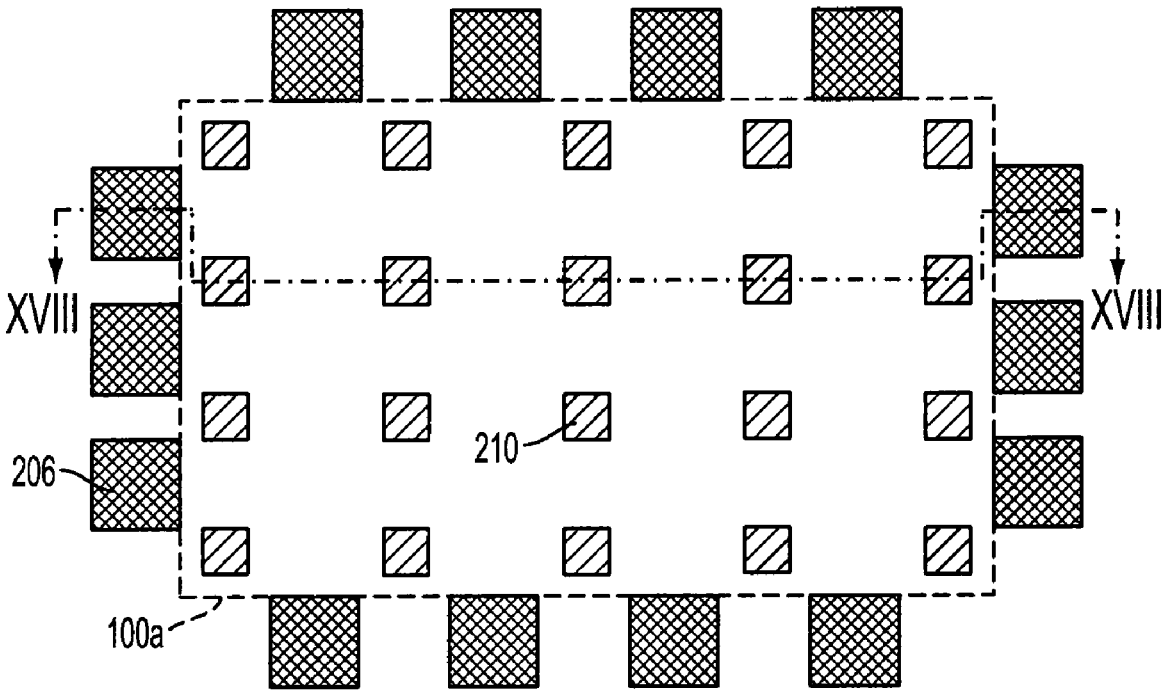
FIG. 17 is a plan view schematically illustrating an arrangement of light-emitting elements and photodetectors within the light-emitting device shown in FIG. 1, according to still another embodiment.
Figure 18:
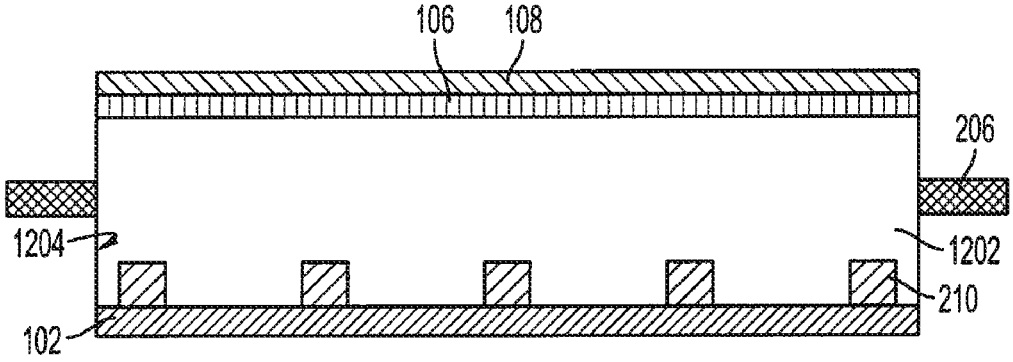
FIG. 18 is a cross-sectional view taken along line XVIII-XVIII of FIG. 17, illustrating exemplary arrangements of light-emitting elements and photodetectors within the light-emitting device shown in FIG. 1, according to one embodiment.

FIG. 17 is a plan view schematically illustrating an arrangement of light-emitting elements and photodetectors within the light-emitting device shown in FIG. 1, according to still another embodiment. FIG. 18 is a cross-sectional view taken along line XVIII-XVIII of FIG. 17, illustrating exemplary arrangements of light-emitting elements and photodetectors within the light-emitting device shown in FIG. 1, according to one embodiment.

Referring to FIG. 17, the plurality of photodetectors 206 are arranged at a plurality of locations outside a periphery of the light-mixing region 100*a* and the plurality of light-emitting elements 210 are arranged within the periphery of the light-mixing region 100*a*.

Referring to FIG. 18, the light-emitting device 100 may be provided in a similar manner as exemplarily described above with respect to FIG. 12. In the illustrated embodiment, however, each of the plurality of photodetectors 206 may be exposed to the light-mixing cavity 1202 via a corresponding opening or partially transmissive region formed in the side surfaces 1204, in a manner similar to that described above with respect to FIG. 16. In one embodiment, each of the plurality of light-emitting elements 210 and the plurality of photodetectors 206 may extend into the light-mixing cavity 1202 via a corresponding opening formed in the side surfaces 1204.

Although the plurality of photodetectors 206 have been described above with respect to FIGS. 4-18 as being arranged either at a plurality of locations outside the periphery of the light-mixing region 100*a* or at a plurality of locations within the periphery of the light-mixing region 100*a*, it will be appreciated that the plurality of photodetectors 206 can be arranged at one or more locations outside the periphery of the light-mixing region 100*a* and at one or more locations within the periphery of the light-mixing region 100*a*. Similarly, although the plurality of light-emitting elements 210 have been described above with respect to FIGS. 4-18 as being arranged either outside the periphery of the light-mixing region 100*a* or within the periphery of the light-mixing region 100*a*, it will be appreciated that one or more of the plurality of light-emitting elements 210 can be arranged outside the periphery and within the periphery of the light-mixing region 100*a*. Lastly, although the plurality of photodetectors 206 have been described as being arranged at the rear surface of the light guide 104 (e.g., as shown in FIGS. 5-7) or at the front surface of the light guide 104 (e.g., as shown in FIGS. 8-10), it will be appreciated that one or more the plurality of photodetectors 206 can be arranged at the rear surface of the light guide 104 and one or more of the plurality of photodetectors 206 can be arranged at the front surface of the light guide 104.

Although the plurality of light-emitting elements 210 have been described above with respect to FIGS. 4-10 and 14-16 as being arranged outside the periphery of the light-mixing region 100*a* along all of the sides of the light-mixing region 100*a*, it will be appreciated that plurality of light-emitting elements 210 may be arranged outside the periphery of the light-mixing region 100*a* along only one of the sides of the light-mixing region 100*a*. It will also be appreciated that the plurality of light-emitting elements 210 may be arranged outside the periphery of the light-mixing region 100*a* along any number of the sides of the light-mixing region 100*a*. In the embodiments exemplarily described above with respect to FIGS. 4-10 and 14-16, the plurality of light-emitting elements 210 are spaced apart from each other at substantially uniform intervals along a side of the light-mixing region 100*a*. It will be appreciated, however, that the plurality of light-emitting elements 210 may be spaced apart from each other at irregular intervals along at least one side of the light-mixing region 100*a*. Further, in the embodiments exemplarily described above with respect to FIGS. 11-13, 17 and 18, the plurality of light-emitting elements 210 are spaced apart from each other at substantially uniform intervals within the periphery of the light-mixing region 100*a*. It will be appreciated, however, that the plurality of light-emitting elements 210 may be spaced apart from each other at irregular intervals within the periphery of the light-mixing region 100*a*.

Although the plurality of photodetectors 206 have been described above with respect to FIGS. 14-18 as being arranged outside the periphery of the light-mixing region 100*a* along all of the sides of the light-mixing region 100*a*, it will be appreciated that plurality of photodetectors 206 may be arranged outside the periphery of the light-mixing region 100*a* along only one of the sides of the light-mixing region 100*a*. It will also be appreciated that the plurality of photodetectors 206 may be arranged outside the periphery of the light-mixing region 100*a* along any number of the sides of the light-mixing region 100*a*. In the embodiments exemplarily described above with respect to FIGS. 14-18, the plurality of photodetectors 206 are spaced apart from each other at substantially uniform intervals along a side of the light-mixing region 100*a*. It will be appreciated, however, that the plurality of photodetectors 206 may be spaced apart from each other at irregular intervals along at least one side of the light-mixing region 100*a*. Further, in the embodiments exemplarily described above with respect to FIGS. 4-13, the plurality of photodetectors 206 are spaced apart from each other at substantially uniform intervals within the periphery of the light-mixing region 100*a*. It will be appreciated, however, that the plurality of photodetectors 206 may be spaced apart from each other at irregular intervals within the periphery of the light-mixing region 100*a*.

Figure 19:
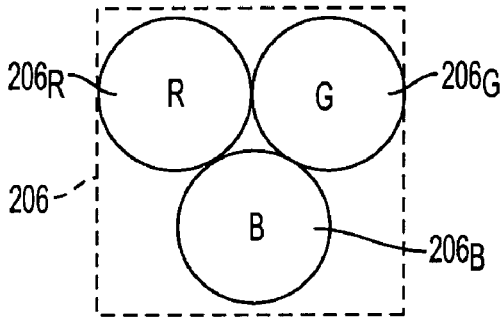
FIG. 19 is a schematic view illustrating an exemplary photodetector that may be incorporated within the light-emitting device shown in FIG. 1 as part of the control system, according to one embodiment.

FIG. 19 is a schematic view illustrating an exemplary photodetector that may be incorporated within the light-emitting device shown in FIG. 1 as part of the control system, according to one embodiment.

Referring to FIG. 19, the plurality of photodetectors 206 may be divided into a plurality of groups of photodetectors, wherein photodetectors within a group of photodetectors are closer to each other than photodetectors of another group. Each photodetector in a group includes a photodiode having a light-receiving region coupled to a color filter configured to transmit light having a predetermined wavelength (or wavelength range) to the light-receiving region. Thus, each photodetector may be sensitive to light having the predetermined wavelength (or wavelength range) due to the presence of the color filter. In one embodiment, each photodetector within a group of photodetectors is sensitive to light having a different wavelength (or wavelength range) than another photodetector within the group of photodetectors. For example, each group of photodetectors 206 may include a red photodetector $\mathbf{206}_R$, a green photodetector $\mathbf{206}_G$ and a blue photodetector $\mathbf{206}_B$. The red photodetector $\mathbf{206}_R$ may include a photodiode having a light-receiving region coupled to a red color filter. Accordingly, the red photodetector $\mathbf{206}_R$ may be sensitive to red light. Similarly, the green photodetector $\mathbf{206}_G$ may include a photodiode having a light-receiving region coupled to a green color filter. Accordingly, the green photodetector $\mathbf{206}_G$ may be sensitive to green light. Lastly, the blue photodetector $\mathbf{206}_B$ may include a photodiode having a light-receiving region coupled to a blue color filter. Accordingly, the blue photodetector $\mathbf{206}_B$ may be sensitive to blue light. In another embodiment, the color filters may be provided as colorimetric (color matching function (CMF) based filters.

Figure 20:
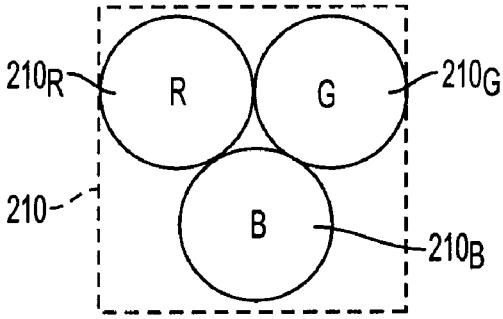
FIG. 20 is a schematic view illustrating an exemplary light-emitting element that may be incorporated within the light-emitting device shown in FIG. 1, according to one embodiment.

FIG. 20 is a schematic view illustrating an exemplary light-emitting element that may be incorporated within the light-emitting device shown in FIG. 1, according to one embodiment.

Generally, each of the plurality of light-emitting elements 210 may be provided as an individual LED (e.g., a white LED, a red LED, a green LED, a blue LED, an amber LED, or the like). It will be appreciated that the colors identified above are merely exemplary and that LEDs capable of emitting any color (e.g., a color having a wavelength range between wavelengths of red and amber, a color having a wavelength range between wavelengths of amber and green, a color having a wavelength range between wavelengths of green and blue, violet, or the like) may be incorporated within the light-emitting device shown in FIG. 1. The light-emitting elements may also be phosphor converted LEDs. In one embodiment, at least one of the plurality of light-emitting elements 210 emits light having a different wavelength range than another of the plurality of light-emitting elements 210. In another embodiment, the plurality of light-emitting elements 210 may be divided into a plurality of groups of LEDs, wherein each LED in the group includes an LED configured to emit light having a predetermined wavelength (or wavelength range). For example, each group of LEDs 210 may include a red LED $\mathbf{210}_R$, a green LED $\mathbf{210}_G$ and a blue LED $\mathbf{210}_B$.

It will be appreciated that several of the above-disclosed and other features and functions, or alternatives thereof, may be desirably combined into many other different systems or applications. It will also be appreciated that various presently unforeseen or unanticipated alternatives, modifications, variations, or improvements therein may be subsequently made by those skilled in the art which are also intended to be encompassed by the following claims.

What is claimed is:

1. A light-emitting device, comprising:

a plurality of light-emitting elements, each of the plurality of light-emitting elements configured to emit light upon receiving electric current;

driving circuitry coupled to the plurality of light-emitting elements, the driving circuitry configured to supply electric current to each of the plurality of light-emitting elements;

a light-mixing region configured to receive light emitted by the plurality of light-emitting elements;

test circuitry coupled to the driving circuitry, the test circuitry configured to control the driving circuitry to supply electric current to a plurality of groups of light-emitting elements in sequence, wherein each of the plurality of groups of light-emitting elements includes one or more of the plurality of light-emitting elements;

a plurality of photodetectors arranged at a plurality of locations of the light-mixing region, wherein each of the plurality of photodetectors is configured to detect an intensity of light present at a location of the light-mixing region and generate a corresponding detection signal;

a reflector having a reflective surface configured to reflect light emitted by the plurality of light-emitting elements to the light-mixing region the reflector having a plurality of openings defined therein and wherein at least one of the plurality of photodetectors is disposed within or below the plurality of openings; and process circuitry coupled to the plurality of photodetectors and the driving circuitry, wherein the process circuitry is configured to process the detection signals generated by the plurality of photodetectors and adjust an electric current supplied to each of the plurality of light-emitting elements based on the processing such that at least one characteristic of light emitted by all of the plurality of light-emitting elements is substantially the same at each of the plurality of locations of the light-mixing region.

2. The light-emitting device of claim 1, wherein at least one of the plurality of light-emitting elements includes a white light-emitting diode (LED), a red LED, a green LED, a blue LED, an amber LED, a violet LED, a phosphor converted LED, an LED capable of emitting light having a wavelength range between wavelengths of red and amber, an LED capable of emitting light having a wavelength range between wavelengths of amber and green, or an LED capable of emitting light having a wavelength range between wavelengths of green and blue.

3. The light-emitting device of claim 1, wherein the at least one characteristic of light includes at one selected from the group consisting of color, color temperature, correlated color temperature, whitepoint, intensity, emittance, and brightness.

4. The light-emitting device of claim 1, wherein at least one of the plurality of light-emitting elements emits light having a different wavelength range than another of the plurality of light-emitting elements.

5. The light-emitting device of claim 1, wherein the plurality of light-emitting elements are arranged within a periphery of the light-mixing region, outside the periphery of the light-mixing region or a combination thereof.

6. The light-emitting device of claim 1, wherein the plurality of photodetectors are arranged within a periphery of the light-mixing region, outside the periphery of the light-mixing region or a combination thereof.

7. The light-emitting device of claim 1, wherein at least a portion of the plurality of light-emitting elements are arranged in an array and at least a portion of the plurality of photodetectors are disposed between light-emitting elements in the array.

8. The light-emitting device of claim 1, wherein at least one of the plurality of photodetectors is disposed above a reflective surface of the reflector, at the reflective surface of the reflector, or below the reflective surface of the reflector.

9. The light-emitting device of claim 1, wherein the reflector comprises at least one partially-transmissive region and wherein at least one portion of the plurality of photodetectors is adjacent to at least one partially-transmissive region.

10. The light-emitting device of claim 1, wherein the light-mixing region includes a diffuser or patterned film.

11. The light-emitting device of claim 10, wherein the light-mixing region includes a light guide, that possesses light outcoupling structures, arranged between the reflector and the diffuser or patterned film.

12. The light-emitting device of claim 11, wherein the plurality of photodetectors are disposed above a rear surface of the light guide, below a front surface of the light guide, along a side surface of the light guide, or a combination thereof.

13. A control system for a light-emitting device, the control system comprising:

test circuitry configured to sequentially cause individual groups of light-emitting elements in a light-emitting device to emit light upon receiving an applied electric current during a test sequence, wherein each group of light-emitting elements includes one or more light-emitting elements;

a plurality of photodetectors configured to detect an intensity of light present at a plurality of locations of the light-emitting device during the test sequence, wherein each of the plurality of photodetectors is configured to generate a detection signal corresponding to a detected intensity of light; and process circuitry configured to process the detection signals generated by the plurality of photodetectors and transmit an adjustment signal based on the processing, wherein the applied electric current is adjustable based on the adjustment signal such that at least one characteristic of light emitted by all of the plurality of light-emitting elements is substantially the same at each of the plurality of locations of the light-emitting device.

14. The control system of claim 13, wherein at least one of the plurality of photodetectors is sensitive to light having a different wavelength range than another of the plurality of photodetectors.

15. The control system of claim 13, wherein the plurality of photodetectors are arranged in a plurality of groups of photodetectors, wherein photodetectors within a group of photodetectors are closer to each other than photodetectors of another group of photodetectors.

16. The control system of claim 15, wherein at least one photodetector within a group of photodetectors is sensitive to light having a different wavelength range than another photodetector within the group of photodetectors.

17. A method of driving a light-emitting device, the method comprising:

performing a test sequence, wherein the test sequence comprises applying electric current to a plurality of groups of light-emitting elements in a light-emitting device to cause the plurality of groups of light-emitting elements to emit light sequentially, wherein each group of light-emitting elements includes one or more light-emitting elements;

detecting an intensity of light present at a plurality of locations of the light-emitting device during the test sequence;

generating a plurality of detection signals corresponding to a detected intensity of light at each of the plurality of locations of the light-emitting device;

processing the detection signals and generating an adjustment signal based on the processing; and transmitting the adjustment signal to a driver configured to apply electric current to the plurality of light-emitting elements such that at least one characteristic of light emitted by all of the plurality of light-emitting elements is substantially the same at each of the plurality of locations of the light-emitting device.

18. The method of claim 17, further comprising performing the test sequence periodically, during dimming of the plurality of light-emitting elements, upon start-up of the light-emitting device, or a combination thereof.

* * * * *